US005697607A

United States Patent [19]

Pache

[11] Patent Number: 5,697,607

[45] Date of Patent: Dec. 16, 1997

[54] DEVICE FOR CONTROLLING GRIPPERS ENGAGING SHEET-LIKE WORKPIECES AT AN INFEED STATION OF A PROCESSING MACHINE

[75] Inventor: Eric Pache, Oulens, Switzerland

[73] Assignee: Bobst SA, Lausanne, Switzerland

[21] Appl. No.: 449,788

[22] Filed: May 24, 1995

[30] Foreign Application Priority Data

May 24, 1994 [CH] Switzerland ..... 01591/94

[51] Int. Cl.[6] ..... B65H 29/04

[52] U.S. Cl. ..... 271/204; 271/277; 271/268; 271/205; 271/82; 271/85

[58] Field of Search ..... 271/277, 268, 271/204, 205, 82, 85

[56] References Cited

U.S. PATENT DOCUMENTS

| | | | |
|---|---|---|---|
| 4,072,260 | 2/1978 | Doue | 271/205 |
| 4,953,897 | 9/1990 | Honeggar | 271/204 |
| 5,199,757 | 4/1993 | Simeth | 271/82 |
| 5,542,657 | 8/1996 | Kemmeren et al. | 271/82 |

FOREIGN PATENT DOCUMENTS

| | | | |
|---|---|---|---|
| 522319 | 1/1993 | European Pat. Off. | 271/204 |
| 28 28 751 | 1/1980 | Germany . | |
| 423925 | 5/1994 | Germany | 271/268 |
| 477 980 | 10/1969 | Switzerland . | |
| WO 87/00822 | 2/1987 | WIPO . | |

*Primary Examiner*—William E. Terrell
*Assistant Examiner*—Khoi H. Tran
*Attorney, Agent, or Firm*—Hill Steadman & Simpson

[57] ABSTRACT

A device for controlling the gripping action of grippers on a plate-like workpiece at the end of the feeding table of a machine that processes sheet-like workpieces has an arrangement for controlling the upper mechanisms for positioning, respectively, the gripper bar, the sheet pull-down appliance, and a stop-carrying tablet and a mechanism for opening the grippers. This device includes a horizontal common axle arranged to extend crosswise to the sheet travelling direction and mounted for rotation around its lengthwise axis so as to be able to be oscillated through a predetermined angle by a single lower drive arrangement consisting of a cam, a lever follower and a pull linkage. Each lateral end of this common axle carries a symmetrical series of articulated arms and cam which actuate the above-mentioned upper mechanisms.

9 Claims, 4 Drawing Sheets

DEVICE FOR CONTROLLING GRIPPERS ENGAGING SHEET-LIKE WORKPIECES AT AN INFEED STATION OF A PROCESSING MACHINE

BACKGROUND OF THE INVENTION

The present invention is directed to a device for controlling the gripping action of a series of grippers on a plate-like workpiece, such as a paper or cardboard sheet. The grippers are mounted on a movable bar in a machine that processes the sheet-like workpiece.

A processing machine usually includes, first of all, an infeed station in which a pile of sheets is arranged. Every sheet is then successively taken from the top of the pile and carried toward a feed table. On this feed table, every sheet is aligned on front lays and side marks or stops prior to being seized on a front edge by a series of grippers mounted along a crossbar, whose ends are attached to lateral continuous chains which move the bar through the machine and, hence, transfer the sheet between the following processing stations. The processing stations may consist of a die-cutting station formed by a platen press, which is usually followed by a waste-stripping station. These processing stations are followed by a delivery station in which every sheet is released by the gripper and is aligned when being dropped on top of a pile which accumulates on an outlet pallet.

More specifically, when the sheet arrives on the feeding table, a plurality of operations have to be executed simultaneously or successively. First of all, the chain train stands still when an empty gripper is advanced into a position for seizing a sheet in front of the downstream edge of the feeding table. The standstill of the chain conveyor is more or less accurate, with the final position of the bar supporting the grippers being readjusted with regard to the fixed table. To obtain the final position, pushers press on either side of the bar onto stops in order to induce a slight shift of the bar with regard to the chain conveyor, and this action is executed contrary to the effect of springs lodged in the mounting fixtures of the bar which are used for attaching the bar to the chain conveyor.

A lower tablet, which, on its downstream edges, carries lays or stops for setting the front position of the sheet, is then raised in such a way that these stops will be located at the level of the gripper in the sheet travelling plane. Moreover, a crosswise steel plate bent to the shape of a so-called sheet pulling-down half-funnel is positioned in order to bring downward toward the gripper and the stops an edge of the sheet which is arriving, which edge may be possibly located too high.

Then, a device controls the opening of the grippers. This device can be a pusher, which raises an arm belonging to the end of a cam shaft which is mounted in the gripper bar, and each cam raises an upper finger of a gripper. Alternatively, this device may include a comb with spaced vertical teeth directed upward, with each of the teeth raising a corresponding upper finger of a gripper during the ascent of this comb.

After a certain time reserved for the advance of the sheet on the positioning stops, the control device closes the grippers, lowers the tablet of the stops, disengages the sheet pulling-down appliance and frees the gripper bar which may move to the following station, which is usually the platen press. If a misalignment of the sheet is detected in the grippers, the sheet having not reached one of the front lays, side marks or stops to switch a relay, an additional device may control the re-opening of the gripper and the standstill of the machine.

With the current machines, the above-described four movements, i.e., the positioning of the gripper bar, the positioning of the tablet, the positioning of the sheet pulling-down appliance, and the opening of the grippers, are controlled separately by individual devices. For reasons of encumbrance and connection to the main drive shaft, every current device is based on a pair of lower cams, one on either side of the machine, which act on a pair of scanning levers that move a vertical pull rod connected to the particular upper mechanisms. Thus, a current machine comprises at least eight sets of cams, levers and pull handles, which makes up a heavy cinematic which is expensive to realize and increases, to the same rate, the driving power necessary to set the machine into operation.

SUMMARY OF THE INVENTION

An object of the present invention is to provide a device for controlling the gripping action of the grippers on the plate-like workpiece and, more specifically, the respective mechanisms for positioning the gripper bar, for positioning the stops-carrying tablet, and for positioning the sheet pulling-down appliance and the mechanism for opening the grippers. These mechanisms are located at the outlet of the feeding table of the machine that processes plate-like workpieces, which should be particularly simplified through remaining efficiency with every machine cycle and reliable at long rate.

These objects are achieved by the fact that the device includes, slightly underneath the downstream edge of the feeding table, a horizontal common axle arranged crosswise to the sheet travelling direction, rotatable around its lengthwise axle and recurrently turning with a predetermined angle by a pair of lower lateral devices at the very most, and by the fact that each lateral end of this common axle carrier has a symmetrical series of articulated arms and/or cam, every pair of cam or arms actuating, respectively, the upper mechanism for positioning the gripper bar, for positioning the stop-carrying tablet and for positioning the sheet pulling-down appliance and the upper mechanism for opening the grippers.

In other words, this rotary axle located slightly beneath the feeding table and set into motion by only one lower drive device or, at the very most, a pair of lower drive devices makes up a common relay for the setting into motion of all of the upper mechanisms. As a matter of fact, it has appeared that it is always possible to redimension the length of an articulated arm or the diameter and profile of a cam according to the same predetermined rotation angle of the common axle in order to obtain the setting into action of the corresponding upper mechanism.

In a preferred embodiment, the lower driving device for setting the common axle into angular movement is a single device and comprises a cam which acts on the first scanning arm or follower of a lever whose other arm lowers a pull linkage or rod which is rotatably connected to a torque arm belonging to the common axle, as well as an elastic pullback means, such as a spring, which acts between a fixed point of the machine and a second torque arm opposite the first torque arm. When properly dimensioned, such a single device can perfectly set into movement all of the upper mechanism in a reliable and repetitive way.

Preferably, the first and second torque arms of the common axle are integral parts of a same piece which comprises, in addition, either a cam segment or serves as a lever arm for one of the upper mechanisms. This configuration allows a savings of components, which is an advantage and will reduce the total cost of the device.

Preferably, two arms or two cams or a neighboring arm and cam acting respectively on two separate mechanisms can hold between them for pivotable movement a linkage for a third mechanism. Thus, the setting into operation of a common axle carrying a plurality of cams or arms allows a savings of additional lever arms when possible.

As an alternative, depending on the place available underneath the feeding table and depending on the position of the end of the main drive shaft, a common axle can be set into rotation by a device which comprises a cam acting directly on a lever belonging to the axle, or comprising a toothed wheel acting on a part of a plate belonging to the axle, the latter part being shaped as a circular toothed segment.

According to the preferred structure of realization, the upper mechanism for locking a gripper bar and lowering the sheet pulling-down appliance comprises a crossbar rotatable around its axial length and located at the same time slightly upstream with regard to the common axle to which the crossbar is extending parallel and slightly beneath the sheet travelling plane. At the center of the crossbar, the crossbar carries the sheet pulling-down appliance and, on either side, a lever arm, whose downstream end carries a scanning roller which rests on a cam belonging to the common axle. Every lever arm being pulled down by the pulling-down means, such as a spring, acting between a common point of the lateral wall of the machine and a fixture located almost in the middle of the lower edge of the lever. The upper edge of every lever arm carries a roller designed to press on a stop of a mounting fixture of a gripper bar which fixture is attached to the chain train.

According to a preferred way of construction, the upper mechanism for opening the gripper comprises, on either side of the machine, a pusher rotatably connected at its lower end to an arm belonging to the common axle and, at its upper end, to a downstream end of a jaw rotatable around the upstream end, the two jaws carrying between them a crosswise comb whose teeth are oriented upward and rest on the corresponding lower sides of the upper fingers of the grippers. Advantageously, the pusher is a jack in its retracted state which, after a first closing of the gripper after a partial rotation of the common axle, can be actuated to raise the jaw and comb again in order to reopen the grippers in case of a misalignment of the sheet.

According to the preferred way of construction, the upper mechanism for raising the stop-carrying tablet, which is mounted for movement around its upstream edge, includes, on either side of the machine, a pusher rotatably connected, at its lower end, to an arm belonging to the common axle and, on its upper end, to a downstream end of the tablet.

In a particularly advantageous way, the common axle and the upper mechanism are contained in a same upper module which may be dismantled and removed from the machine. As a matter of fact, this module is connected only by one single pull element to the lower device for setting into rotation the common axle or, at the very most, by a pair of pull linkages. The removal of the module is easy, which fact is appreciated for the repair of the machine or in resetting into operation after a sheet jam.

Other advantages and features of the invention will be readily apparent from the following description of the preferred embodiments, the drawings and claims.

DESCRIPTION OF THE PREFERRED EMBODIMENTS

Figure 1:
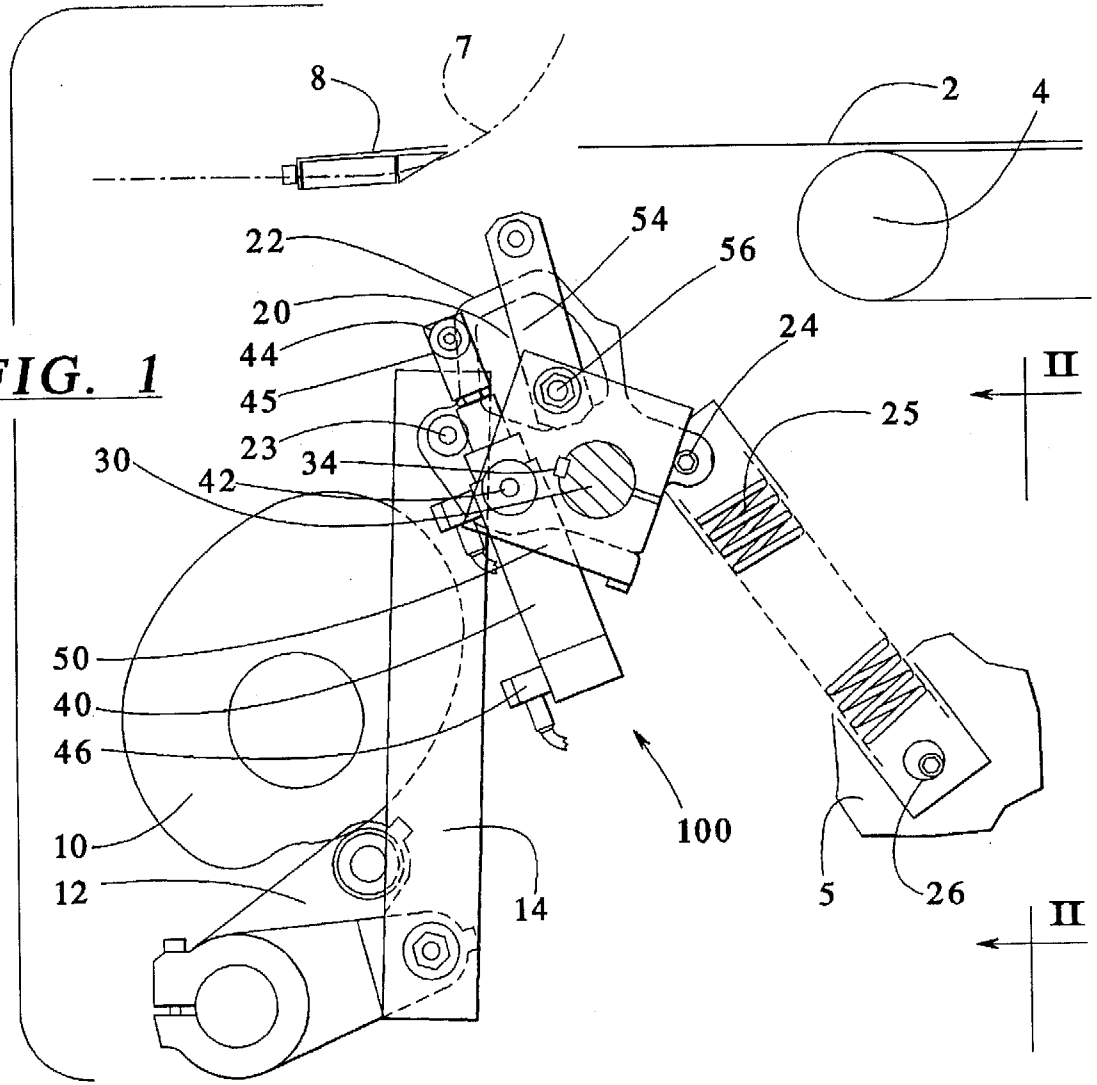
FIG. 1 is a partial side view of the control device according to the present invention.
Figure 2:
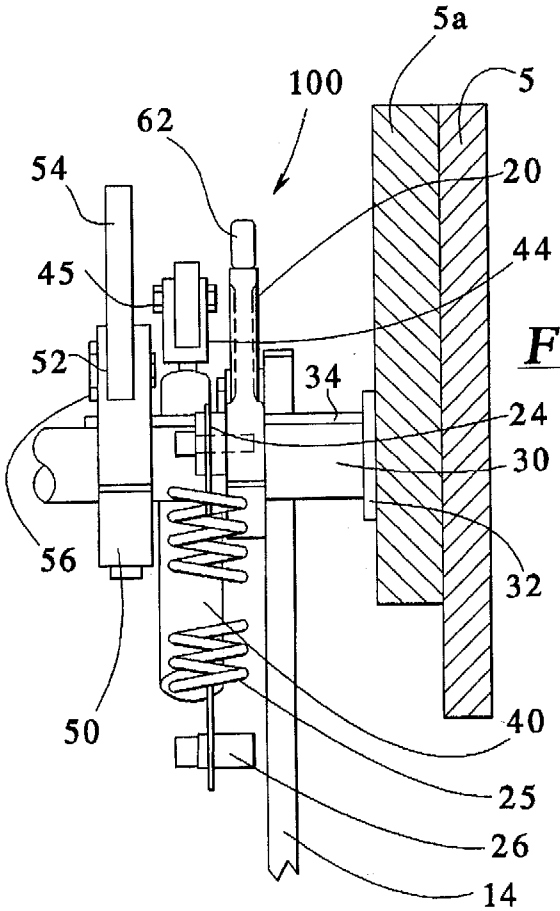
FIG. 2 is a partial front view taken in the direction of arrow II of FIG. 1 with portions broken away for purposes of illustration of the device of FIG. 1.
Figure 3B:
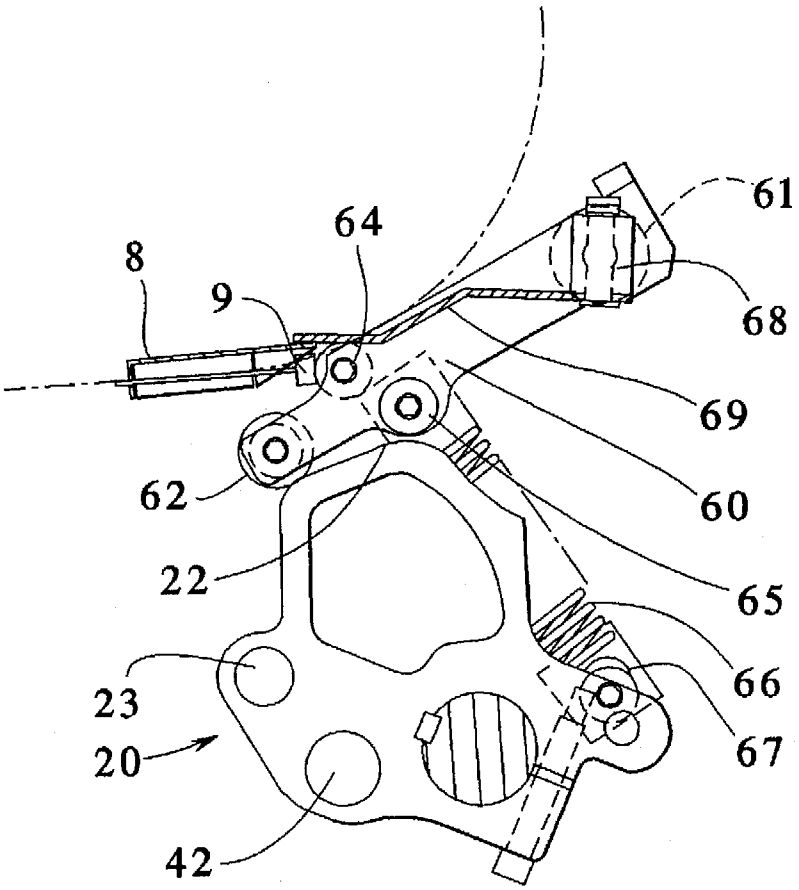
FIGS. 3*a* and 3*b* are partial side views of the mechanism for locking a gripper bar and lowering the sheet-pulling appliance, respectively, with FIG. 3*a* showing the mechanism and appliance in an inoperative or retracted position and FIG. 3*b* showing it in the operative position.
Figure 3A:
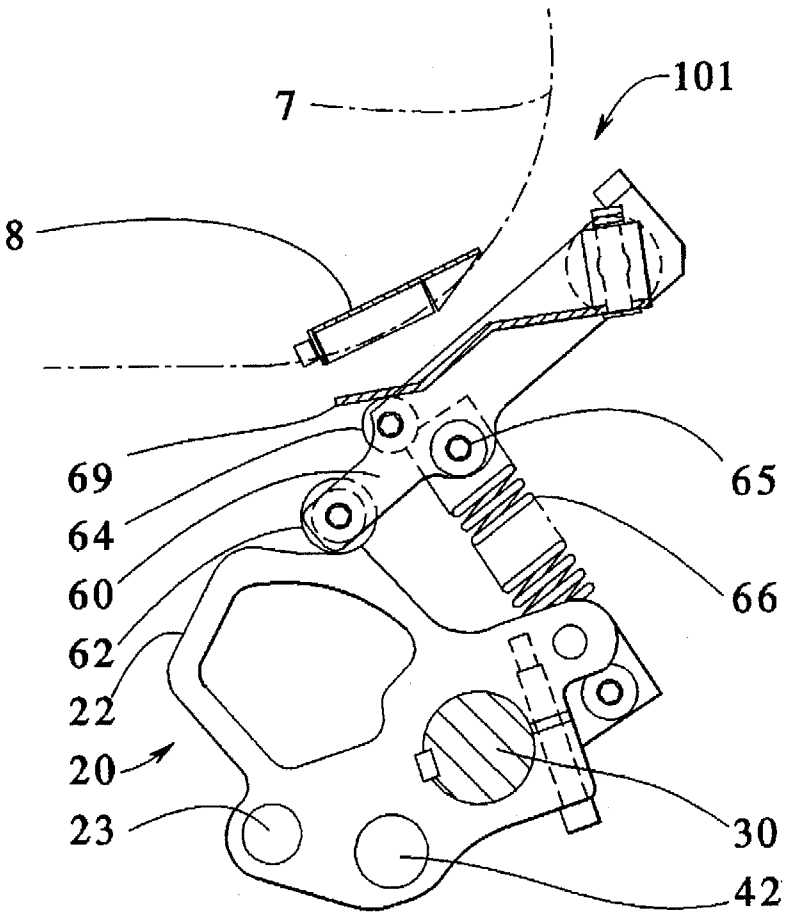
Figure 4C:
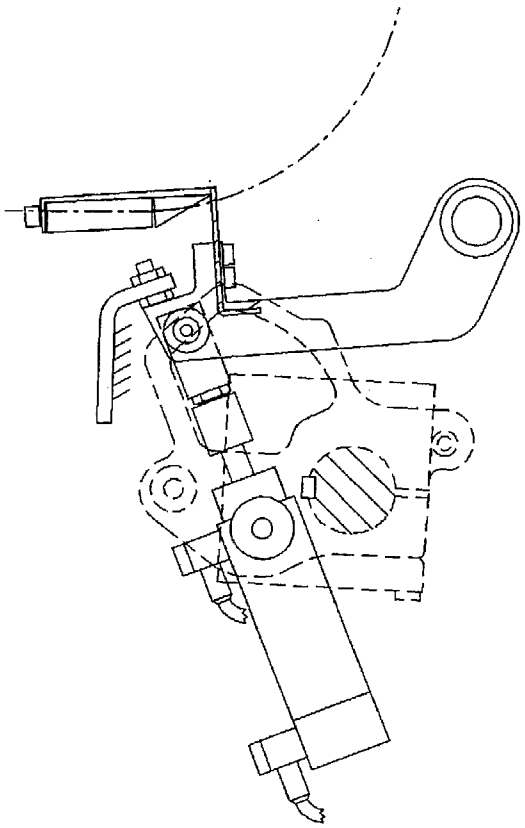
FIGS. 4*a*, 4*b* and 4*c* are side views of details of the mechanism for opening the gripper, with FIG. 4*a* showing the retracted or disengaged position, FIG. 4*b* showing the position for opening the gripper, and FIG. 4*c* showing the position for reopening in case of a misalignment of the sheet.
Figure 4B:
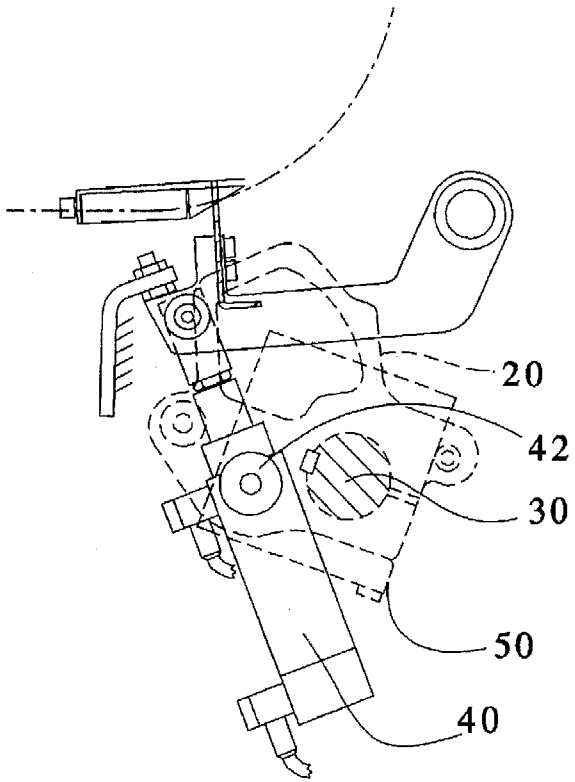
Figure 4A:
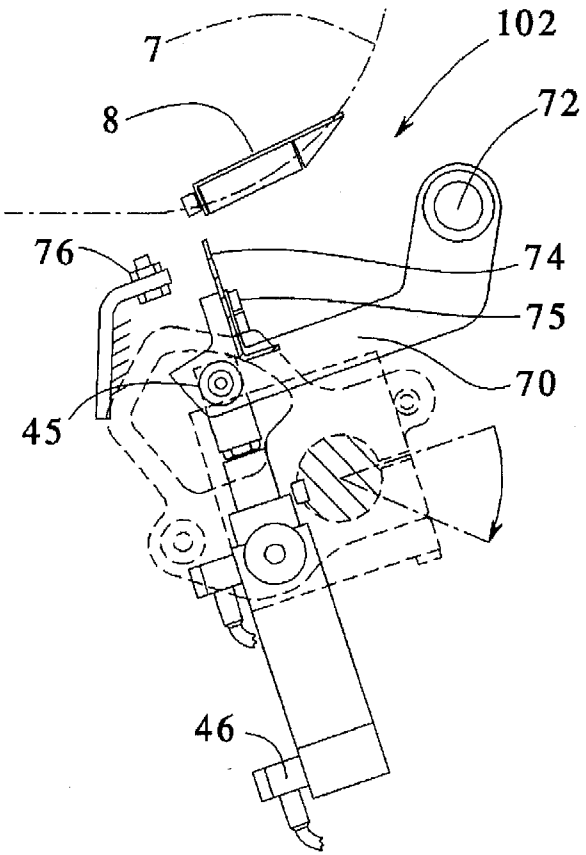
Figure 5B:
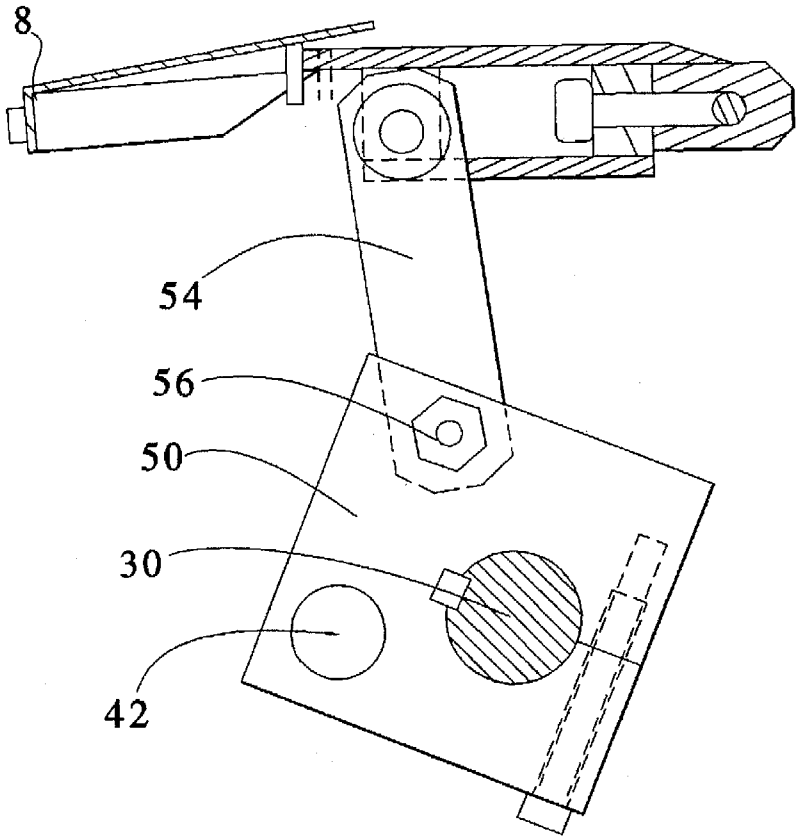
FIGS. 5*a* and 5*b* are partial side views of the mechanism for raising the stop-carrying tablet, with FIG. 5*a* showing the retracted or withdrawn position and FIG. 5*b* showing the raised or active position.
Figure 5A:
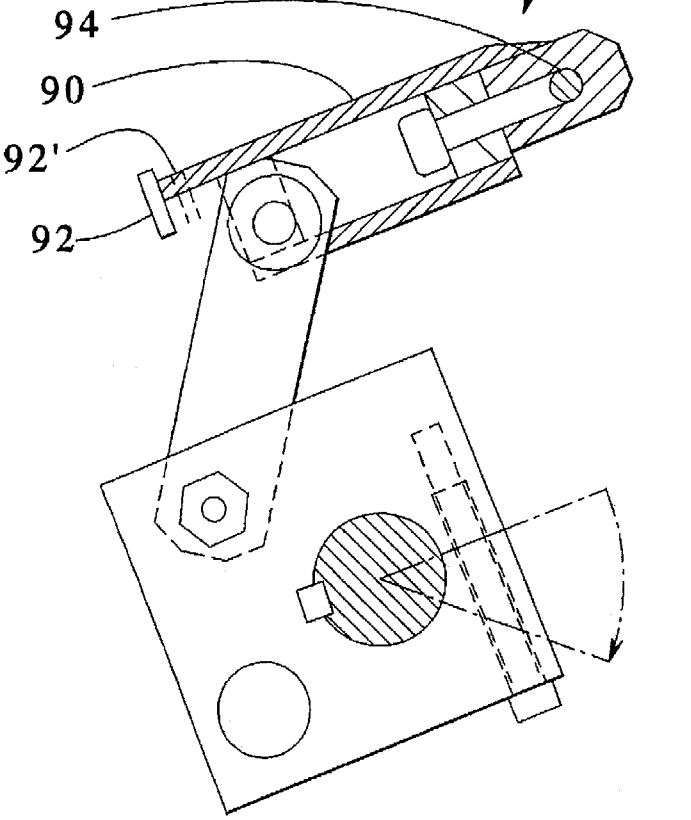

The principles of the present invention are particularly useful when incorporated in a device, generally indicated at 100 in FIGS. 1 and 2, for controlling a plurality of mechanisms, including a mechanism, generally indicated at 101 in FIG. 3*a*, for positioning the gripper bar and positioning the sheet pulling-down appliance, a mechanism, generally indicated at 102 in FIG. 4*a*, for opening and closing the grippers and a mechanism, generally indicated at 103 in FIG. 5*a*, for raising and lowering the tablet. These mechanisms are all located at the outlet of the feeding table 4 (FIG. 1), and insure the gripping action of the grippers 8, which are fitted on a bar driven on either side by a continuous chain train 7 at an exact position for the sheet 2. The control device 100 is centered on a horizontal common axle 30 oriented to extend crosswise with regard to the sheet travelling direction and held rotatably in bearings 32 in walls 5*a* of a module mounted on lateral walls 5 of the machine, as best illustrated in FIG. 2.

The axle 30 is reciprocated or oscillated through an angle of approximately 50° by a subjacent driving device, which includes a control cam 10 (FIG. 1 ) whose position is determined by a first arm of a lever 12, whose other arm is pivotably connected to a pull linkage or rod 14. The pull rod 14 has an upper end connected by a pivotable connection 23 to a drive element or cam 20, which is mounted on the axle 30 and is keyed thereto by a cotter or key 34. The axle of the cam 10 extends through a lateral wall 5 of the frame of the machine in order to be connected to the main drive of the machine, for instance by a chain belt. The axle of the lever 12 is also held by a bearing in the same lateral wall 5 of the frame.

The drive element or cam 20 is connected by a pivotable connection 24 to a first end of a spring 25, whose lower or other end is connected to a fixed mounting point 26 on the lateral wall 5 of the frame. As visible in FIG. 1, the point of the pivotable connection 23 of the pull rod 14 and the point of the pivotable connection 24 of the spring are located on either side of a rotation axle 30 in such a way that the counterclockwise rotation of the lever cam 20 induced by a downward movement of the pull linkage 14 is effectuated contrary or against the elongation of the spring 25 which, later, will bring the lever cam 20 back into the initial position when the scanning roller of the lever 12 passes into a low area of the cam 10.

When this lower drive device is properly dimensioned, there is no need to duplicate this on the other lateral wall of the frame.

More particularly, according to the present invention, every end of the axle 30 has the long key 34 aligned for simultaneously rotating a plurality of mechanical drive elements 20, 40 and 50 located side-by-side, as shown in FIG. 2.

More precisely, the first element, i.e., the above mentioned cam or element 20, has, in an upper part, a cam segment 22 (best illustrated in FIGS. 3*a* and 3*b*), which is used to actuate the mechanism 101 for locking the position of the gripper bar and setting into position of a sheet pulling-down appliance.

As illustrated in FIGS. 3*a* and 3*b*, the mechanism 101 includes an axle 61 extending parallel to the axle 30. A lever 60 is mounted on the axle 61 closely adjacent to each lateral wall of the frame and moves in a path parallel to the frame. The lever 60, on a downstream end, carries a cam follower or scanning roller 62, which rests on a cam segment 22 of the subjacent lever cam 20. Every lever 60 is pulled downward onto the cam segment 22 by a spring 66, which is pivotably mounted at 65 to the lever 60 and has its other ends pivotably mounted at 67 on a lateral wall of the frame or a portion of the wall of the module. The lever 60, on an upper surface, carries a locking roller 64.

In fact, the two lateral levers belong to the same crossbar 68, which has a non-circular section, except at the two ends which are respectively engaged in bearings included in the lateral walls of the frame or module and the crossbar 6 to form the rotation axle 61. This crossbar 68 also carries, in its center, a steel plate 69 oriented to extend downstream with regard to the sheet travelling direction and bent downward in a slant by at least one bend.

As illustrated in FIG. 3*a*, the beginning of the sequence of the cycle during which the gripping bar 8 is brought into position by the chain train 7. During this period, the cam 20 has been completely turned counterclockwise to a retracted position and the scanning roller 62 is in contact with the lowermost part of the segment 22 to set the lever 60 in its lower or retracted position. Soon after the chain train 7 has brought the gripper bar 8 into position for seizing a sheet, the clockwise rotation of the lever cam 20 has quickly raised the lever 60, which action pushes the upper roller 64 against a supporting stop made in a loose part of the fixture or mount of the gripper bar, which is attached to the chain 7. This rest of the roller 64 on the stops 9 causes a final positioning of the gripper bar to be established with reference to the machine instead of with reference to the chain train. Moreover, with the raised position of the lever 60, the pull-down steel plate 69 is able to guide the front edge of the sheet toward the gripper 8.

A second device for actuating a mechanism 103, which turns simultaneously with the common axle 30, is formed by a plate 50 mounted on the axle parallel to the lever cam 20 and on the inside of the machine relative to the cam 20, as illustrated in FIG. 2. This plate 50, which is also keyed on the axle 20, has a slot for receiving a lower end of a vertical pusher 54, which is pivotably connected to the plate by a pivotable connection 56. An upper end of the pusher 54 is connected by a pivotable connection to a downstream end of a tablet 90, which turns or oscillates around an axle 94 that extends parallel and close to its upstream edge. This tablet carries, on its downstream edge, a plurality of front lays or stops 92. As illustrated in FIG. 5*b*, after the clockwise rotation of the axle 30, the pusher 54 has raised the tablet 90 until the lays 92 are brought between open grippers 8. The position of these lays 92 is preset more or less relative to an end of the grippers 8 up to the ultimate position 92', depending on the size of the plate-like workpiece.

To actuate the mechanism 102 of FIG. 4*a* to open and close the gripper, a third element for actuating this mechanism consists of a jack 40, which is not connected directly the axle 30 but is hung on a horizontal axle which extends between the cam 20 and the plate 50. The jack is fed by a hydraulic duct 46. As visible in FIGS. 4*a*, 4*b* and 4*c*, the upper end of the jack is bifurcated to form a knuckle 44 (see FIG. 2) and is pivotably connected by a pin or axle 45 to a downstream end of a jaw or lever 70(See FIGS. 4*a*, 4*b* and 4*c*), which turns on its upstream end around a horizontal axle 72. In a way similar to the above-described mechanism, every jaw 70 moves in a plane parallel and close to the corresponding lateral walls of the frame. These two lateral jaws or levers 70 carry between them, by means of fastening bolts 75, a crosswise comb 74, which is visible in FIGS. 4*b* and 4*c*, which is foreseen to raise an upper finger of every gripper 8 after the clockwise rotation of the common axle 30. After this rotation of the axle 30, the ascent of the downward edge of the jaw 70 is limited by an adjustable stop 76, which is mounted on the frame. The closing of the gripper occurs very quickly after the beginning of the counterclockwise rotation of the common axle 30.

As described above in its functions, a simple push rod could take the place of the jack 40. However, it might happen that a sheet does not reach the stop for the setting into position and that the sheet is seized askewed by the grippers. This condition is detected by the fact that the sheet will not have activated a switch located in the vicinity of every stop. The movement of the jack from the retracted state shown in FIG. 4*b* to the extended state shown in FIG. 4*c* allows a temporary raising of the jaw 70 toward the stop 76 in such a way to reopen the gripper 8, which then releases the misaligned sheet. The standstill of the frame for disengaging the sheet is then very short by the fact that this sheet is still present on the feeding table, hence, in a very accessible area.

As may be gathered from the reading of this description, the use of the crosswise axle 30 allows the simultaneous and coordinate setting into operation of a plurality of upper mechanisms 101,102 and 103, which are illustrated in FIGS. 4 and 5, from a single basic lower drive including the cam 10 and elements 11–14. This lower drive is dimensioned so as to be sufficiently powerful for transmitting the necessary mechanical power. On the other hand, the single drive allows the replacement of at least five anterior traditional drives, which represent a considerable reduction of the components for the machine. Among others, this coordinated drive of a plurality of mechanisms 101, 102 and 103 has been possible owing in particular shapes given to the drive elements 20, 40 and 50, which shapes are represented exactly through FIGS. 1 and 2. This coordination is also possible due to the corresponding dimensions of the lever 60 of the mechanism 101 of FIG. 3, of the jaw or lever 70 of the mechanism 102 of FIG. 4, and of the pusher 54 of the mechanism 103 of FIG. 5*a*. These dimensions are represented in these Figures with the same scale as the adjacent pieces in order to set forth the proportion rates.

Moreover, it appears possible to mount these parts in a modular casing having such end walls 5*a* (FIG. 2), which module may be then removed or dismantled so that the axle 30 with its drive elements 20, 40 and 50, as well as the mechanisms 101, 102 and 103, can be removed together.

Although various minor modifications may be suggested by those versed in the art, it should be understood that I wish to embody within the scope of the patent granted hereon all such modifications as reasonably and properly come within the scope of my contribution to the art.

I claim:

1. A device for controlling the gripping action of grippers on a plate-like workpiece at the end of a feeding table of a machine that processes said workpieces, said device comprising a first mechanism for positioning a gripper bar and for positioning a sheet pull-down appliance, a second mechanism for positioning a stop-carrying tablet and a third mechanism for opening the grippers, said device including a horizontal common axle arranged to extend crosswise to the direction of the sheet travel, means mounting the axle for rotation in the device, first drive means for oscillating the common axle between a predetermined angle, the ends of said common axle carrying a symmetrical series of articulated arms and a cam element, said arms and cam element actuating, respectively, the first mechanism for positioning the gripper bar and for pivoting the sheet pull-down appliance, the second mechanism for positioning the stop-carrying tablet and the third mechanism for opening the grippers.

2. A device according to claim 1, wherein first means for oscillating the common axle comprises a single device composed of a cam which acts on a first scanning arm of a lever having a second arm pivotably connected by a linkage to a torque arm attached to said common axle and an elastic pull-back means which acts between a fixed point of the machine and a second torque arm positioned opposite to the first torque arm.

3. A device according to claim 2, wherein the first and second torque arms are integral parts of a same piece which includes a cam segment for actuating the first mechanism for positioning the gripper bar and positioning the sheet pull-down appliance, and said piece providing a lever arm for actuating the third mechanism for opening the grippers.

4. A device according to claim 1, wherein the arm and cam element on each end of said common axle rotate with said axle with the cam element actuating the first mechanism and the arm actuating the second mechanism for positioning the tablet and said arm and cam element supporting a linkage for actuating the third mechanism for opening the grippers.

5. A device according to claim 1, wherein the first mechanism for positioning a gripping bar and positioning the sheet pull-down appliance comprises a crossbar mounted for rotation on its lengthwise axis and to extend parallel to the common axle and being located upstream thereof and slightly above the sheet travelling plane, said crossbar carrying, on its center, a sheet pull-down appliance and, on each side, a lever arm having a free end carrying a scanning roller resting on a cam belonging to the common axle, every lever arm being pulled downward by a pull-back means acting between a lower point of the lateral wall of the machine and a pivotable connection located on the lower edge of the lever, an upper edge of every lever arm carrying a roller to press on a stop of a mounting fixture which attaches the gripper bar to a chain train for the gripper bars.

6. A device according to claim 1, wherein the third mechanism for opening the grippers comprises, on both sides of the machine, a pusher connected to an arm provided on said common axle, said pusher, at the upper end, being pivotably connected to a downstream end of a jaw rotatable around an upstream end, said two jaws carrying therebetween a crosswise comb having spaced vertical teeth oriented to extend upward to rest on a corresponding lower side of upper fingers of each gripper.

7. A device according to claim 6, wherein said pusher is in the form of a jack which, in a retracted state, after a first closing of the grippers after a partial rotation of the common axle, can be actuated to raise the jaws and comb again in order to reopen the grippers in case of a misalignment of the sheet.

8. A device according to claim 1, wherein the second mechanism for positioning a stop-carrying tablet said tablet adjacent an upstream edge being mounted for pivotable movement, said means for controlling including a pusher rotatably connected, at its lower end, to an arm provided on said common axle and, at its upper end, to a downstream end of the tablet.

9. A device according to claim 1, wherein the common axle carrying the cams and articulated arms, the first mechanism for positioning of a gripper bar and for positioning the sheet pull-down appliance, the second mechanism for positioning a stop-carrying tablet and the third mechanism for opening the grippers are mounted in a sub-frame forming a module which may be removed from said machine.

* * * * *